US010022571B2

(12) United States Patent
Jones et al.

(10) Patent No.: US 10,022,571 B2
(45) Date of Patent: Jul. 17, 2018

(54) RESCUE DESCENDER SYSTEM

(75) Inventors: Owain Jones, Chippenham (GB); Karl Jones, Devizes (GB)

(73) Assignee: Latchways PLC, Wiltshire (GB)

( * ) Notice: Subject to any disclaimer, the term of this patent is extended or adjusted under 35 U.S.C. 154(b) by 0 days.

(21) Appl. No.: 13/885,719

(22) PCT Filed: Nov. 18, 2011

(86) PCT No.: PCT/GB2011/052256

§ 371 (c)(1),
(2), (4) Date: Jun. 5, 2013

(87) PCT Pub. No.: WO2012/066345

PCT Pub. Date: May 24, 2012

(65) Prior Publication Data

US 2013/0248291 A1 Sep. 26, 2013

(30) Foreign Application Priority Data

| | | |
|---|---|---|
| Nov. 18, 2010 | (GB) | 1019462.9 |
| Jul. 18, 2011 | (GB) | 1112332.0 |
| Jul. 18, 2011 | (GB) | 1112334.6 |

(51) Int. Cl.

| | |
|---|---|
| ***A62B 1/10*** | (2006.01) |
| ***A62B 1/14*** | (2006.01) |
| ***A62B 35/00*** | (2006.01) |

(52) U.S. Cl.

CPC ..... *A62B 1/10* (2013.01); *A62B 1/14* (2013.01); *A62B 35/0018* (2013.01); *A62B 35/0037* (2013.01); *A62B 35/0043* (2013.01)

(58) Field of Classification Search

CPC ..... A62B 35/00; A62B 35/04; A62B 35/0093; A62B 1/00; A62B 1/06; A62B 1/08; A62B 1/10; A62B 1/14

USPC .... 182/231, 235, 71, 72, 73, 236, 240, 5, 3, 182/232, 237, 241; 188/65.2, 65.4, 65.5

See application file for complete search history.

(56) References Cited

U.S. PATENT DOCUMENTS

| | | | | |
|---|---|---|---|---|
| 876,840 A * | 1/1908 | Reuter | 182/3 | |
| 3,946,989 A * | 3/1976 | Tsuda | A62B 1/10 182/241 | |
| 4,018,423 A * | 4/1977 | Belew | A62B 1/12 182/238 | |

(Continued)

FOREIGN PATENT DOCUMENTS

| | | |
|---|---|---|
| GB | 2414005 A | 11/2005 |
| WO | WO2009027619 A1 | 3/2009 |

*Primary Examiner* — Katherine W Mitchell
*Assistant Examiner* — Shiref M Mekhaeil
(74) *Attorney, Agent, or Firm* — Gordon & Jacobson, P.C.

(57) ABSTRACT

A descender system, typically for use in a fall arrest system, for enabling a suspended body to be lowered includes a rotatable descent line drum, and a release element arranged in a restraint configuration to inhibit the descent line from being deployed and in a release configuration to permit the descent line to be deployed. A rotating brake applies a braking force to the rotatable descent line drum; a gear train connects the brake to the drum. The gear train is provided in a substantially watertight sealed space. Typically, a substantially watertight seal is provided between a backplate of the rotating drum and a chassis of the device. Typically, the substantially watertight seal is of a material that is deformable/compressible, preferably at temperatures at or below −20 Celsius.

18 Claims, 13 Drawing Sheets

(56) References Cited

U.S. PATENT DOCUMENTS 4,088,201 A * 5/1978 MacFarlane ..... A62B 1/12 182/5
4,114,875 A * 9/1978 Deluty ..... A63B 21/018 188/65.1
4,394,992 A * 7/1983 Fohl ..... B60R 22/28 188/65.3
4,437,546 A 3/1984 Marinoff
4,511,123 A * 4/1985 Ostrobrod ..... A62B 1/10 182/234
4,576,248 A * 3/1986 Marom ..... A62B 1/14 182/5
4,938,435 A * 7/1990 Varner ..... B64D 25/00 182/231
5,186,289 A * 2/1993 Wolner ..... A62B 1/12 182/232
5,850,893 A * 12/1998 Hede ..... A62B 1/14 182/193
5,924,522 A * 7/1999 Ostrobrod ..... A62B 1/14 182/191
5,927,438 A * 7/1999 Ostrobrod ..... A62B 1/08 182/192
6,029,777 A * 2/2000 Rogelja ..... A62B 1/14 182/192
7,188,704 B2 * 3/2007 Renton ..... A62B 35/04 182/18
7,780,146 B2 * 8/2010 Casebolt ..... A62B 1/10 182/235
7,963,370 B2 * 6/2011 Hwang ..... A62B 1/10 182/236
8,061,479 B2 * 11/2011 Harris, Jr. ..... A62B 35/0093 182/3
8,245,817 B2 * 8/2012 Casebolt ..... A62B 35/0093 182/231
8,312,964 B2 * 11/2012 Harris, Jr. ..... A62B 1/14 182/187
8,794,392 B2 * 8/2014 Kowatsch ..... A62B 1/08 182/192
8,950,551 B2 * 2/2015 Jones ..... A62B 35/0093 182/231
2006/0113147 A1 * 6/2006 Harris, Jr. ..... A62B 35/0093 182/3
2007/0261921 A1 * 11/2007 Gal ..... A62B 1/08 182/233
2009/0084631 A1 4/2009 Casebolt
2009/0173578 A1 * 7/2009 Renton ..... A62B 1/08 182/235
2010/0122874 A1 * 5/2010 Harris, Jr. ..... A62B 35/0093 182/231
2010/0163338 A1 * 7/2010 Wood ..... A62B 35/04 182/6
2010/0252366 A1 * 10/2010 Jones ..... A62B 35/0093 182/232
2010/0282541 A1 * 11/2010 Renton ..... A62B 1/18 182/234
2012/0073904 A1 * 3/2012 Harris, Jr. ..... A62B 35/0093 182/231
2014/0190770 A1 * 7/2014 Renton ..... A62B 1/10 182/239
2014/0224583 A1 * 8/2014 Wood ..... A62B 1/14 182/6

* cited by examiner

RESCUE DESCENDER SYSTEM

CROSS-REFERENCE TO RELATED APPLICATIONS

This application claims priority from PCT/GB/2011/052256 filed on Nov. 18, 2011, GB 1019462.9 filed on Nov. 18, 2010, GB 1112334.6 filed on Jul. 18, 2012, and GB 1112332.0 filed on Jul. 18, 2011, all of which are hereby incorporated by reference in their entireties.

BACKGROUND OF THE INVENTION

1. Field of the Invention

The present invention relates to a rescue descender system primarily, but not exclusively for use in fall arrest or fall safety systems for personnel safety when working at height.

2. State of the Art

Fall arrest or fall safety systems are known in which personnel working at height are secured to a safety line in order to arrest a fall, should this occur. Such safety lines can comprise a self retracting lifeline which includes a safety block secured to an anchor point and a safety line which pays out as the user moves away from the safety block. A brake device engages to prevent paying out of the safety line in the event of a fall. Typically the system includes an energy absorption device arranged to absorb the energy of the fall when the line payout stops in order to arrest the fall.

Typically, in the circumstances of a fall, the user can be left suspended in mid air. In order to be rescued, the user can be hooked from above by a rescuer (if in reach and accessible), or a rescuer can descend to the individual to attach them to a rescue line. Alternatively, devices have been proposed to enable a suspended user to self instigate lowering to ground or rescue level. Such arrangements are disclosed in, for example, GB2414005 and WO2009/027619. Such systems can be referred to as self rescue devices. WO2009/027619 discloses a self rescue device that has a rescue line drum connected to a brake arrangement in order to control the rate of descent. This is achieved by means of a gear train connecting the drum and the brake. In very cold climates moisture present in the gear train can freeze and cause malfunction of the apparatus.

An improved arrangement has now been devised.

SUMMARY OF THE INVENTION

According to a first aspect, the present invention provides a descender device for enabling a suspended body to be lowered, the descender system comprising:

- a rotatable descent line drum,
- a release element arranged in a restraint configuration to inhibit the descent line from being deployed and in a release configuration to permit the descent line to be deployed;
- a brake arrangement to apply a braking force to the rotatable descent line drum; the brake arrangement comprising a rotating brake and a gear train connecting the brake to the drum; wherein the gear train is provided in a substantially watertight sealed envelope or environment.

It is preferred that a substantially watertight seal is provided between a backplate of the rotating drum and a chassis of the device.

Beneficially, the substantially watertight seal is of a material that is deformable/compressible, preferably at temperatures at or below −20 Celsius.

In a preferred embodiment the substantially watertight seal comprises a silicon gasket.

It is preferred that the brake is provided in a walled enclosure having an end cap fitted; a seal being provided between the end cap and the wall of the enclosure.

In a preferred embodiment, the drum is mounted with an axial bolt, the axial bolt having a circumferential seal (such as an O' ring seal).

In a preferred embodiment, the device is provided with a back cover mounted to the chassis; the back cover and chassis being provided with an intermediate seal.

The action of providing the seals as described provides a substantially watertight chamber or envelope about the gear train that is robust enough to be maintained even in extreme cold conditions. The flexible resilient seal positioned between the backplate surface of the drum and the chassis is particularly important in this regard.

It is preferred that the descender device includes a clamp arrangement arranged prior to deployment of the descent line, to clamp or pinch the descent line, and/or a length of release line connected to the descent line, at one or more points intermediate the opposed ends of the line and spaced from the release means, the clamp arrangement being reconfigurable when, the release element is in the release configuration, to permit the line to pass; and/or

- the release element is connected to a pull tether, which pull tether extends in a harness over a shoulder portion of the harness; and/or
- the release element secures through a loop or ring, which loop or ring is attached to a flexible line.

In a preferred realisation of the invention, moving of the release means to the release configuration permits, or causes, the clamp arrangement to reconfigure from the clamping position, to permit the line to pass.

In one embodiment, the clamp arrangement may comprise a plurality of bars spaced on a rack, the descent line passing serpentine-wise through the bars in the rack.

Beneficially, the spacing of the bars on the rack can reduce or diminish to clamp the descent line between the bars, and also preferably expand or increase to permit the descent line to pass via the bars in the rack.

It is preferred in this embodiment that moving of the release means to the release configuration permits or causes the spacing between the bars on the rack to expand from the reduced spacing configuration.

It is preferred that the release means comprises a pin. The release mans is preferably connected to a tether line which can be pulled by the user to dislodge the pin from the restraint position in appropriate circumstances According to a further aspect, the present invention provides a fall arrest system incorporating a descender system as defined herein.

The invention will now be further described, by way of example only, and with reference to the accompanying drawings.

DETAILED DESCRIPTION OF THE PREFERRED EMBODIMENTS

Figure 1A:
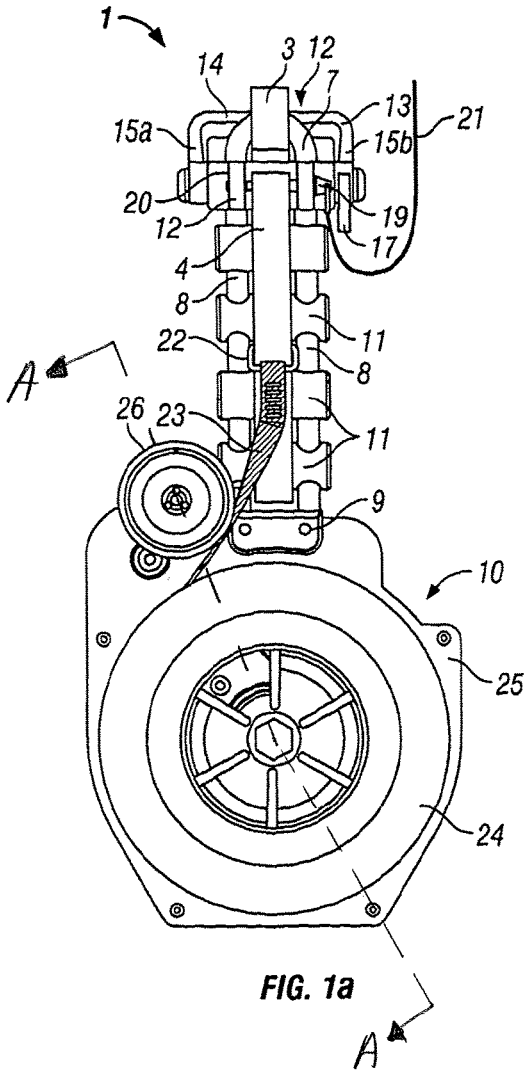
FIGS. 1A and 1 B are face and side views respectively of a first embodiment of a rescue descender device 1 in accordance with the invention in an initial or first configuration.

Referring to the drawings there is shown a rescue descender device 1 in accordance with the invention. As shown in FIGS. 6A to 6D, the rescue descender device 1 is arranged to be worn on the back of a user mounted to a body harness 70 and be connected to a fall arrest lifeline 71, such as a self retracting lifeline as are known in the art.

The rescue descender device 1 comprises, a first length of binding webbing 2 comprising an upper loop 3, a lower loop 4 and an intermediate webbing length 5 which is stitched together to form a double thickness between the upper and lower loops 3,4. The upper loop 3 of the first length of webbing is arranged to be connected to a fall arrest lifeline such as the self retracting lifeline 71 as are known in the art.

The first length of binding webbing 2 is wrapped, serpentine fashion, around a restraint device 6 which comprises a U shaped frame 7 having spaced limbs 8, at their upper ends joined by a curved crosspiece, and at their lower ends connected to a fixing bracket 9 connected to a descent line store device 10.

A series of movable pinch bars 11 are mounted on the spaced limbs 8 and the first length of binding webbing 2 is wrapped around the movable pinch bars 11 as shown in the figures in serpentine fashion. The movable bars 11 can slide up and own the spaced limbs 8, upward movement being limited by a load arm mounting component 12 that is fixed relative to the U shaped frame 7. The movable pinch bars 11 are provided with respective bores to accommodate the limbs 8. The load arm mounting component 12 carries a pivotally mounted pivoting load arm 13 which has a cross bar 14 and a pair of spaced arms mounting arms 15*a* 15*b*. The pivoting load arm 13 is connected by a webbing loop harness connector 16 to the safety harness (not shown) worn by a user. The webbing loop harness connector 16 is looped around the cross bar 14 of load arm 13.

Figure 1B:
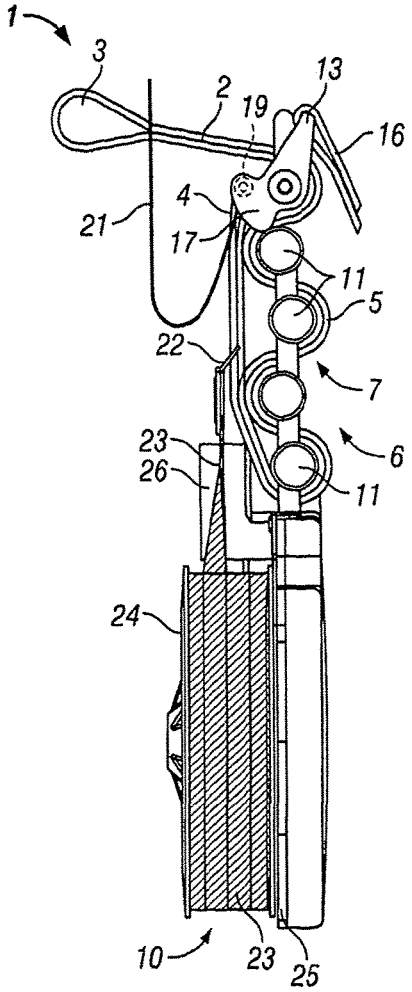

The pivoting load arm 13 is provided with an abutment piece 17 such that when the pivoting load arm 13 is biased to its normal at rest position (as shown in FIGS. 1A and 1B) by the biasing torsion spring 18, the abutment piece 17 is positioned to lie adjacent the head of a release pin 19, which is mounted in respective receiving bores 20 of the mounting component 12. The head of the release pin 19 is connected to an end of a pin release tether 21. The lower loop 4 of the first length of webbing 2 is connected via a connector clasp 22 to a descent line 23. The descent line 23 is fixed at its other end and is wound on a descent line drum 24.

Figure 2:
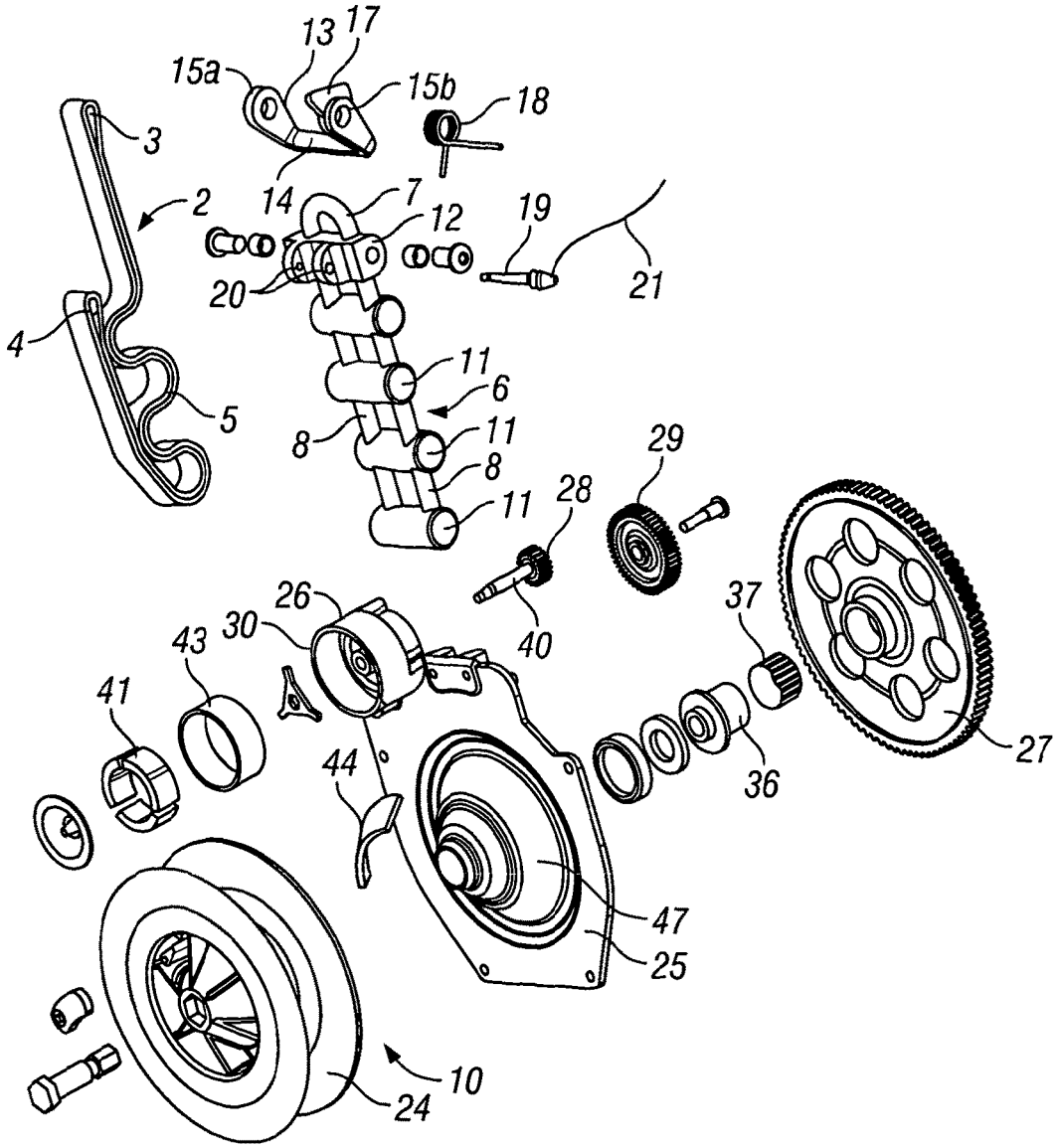
FIG. 2 is a schematic perspective exploded view of the rescue descender device 1 of figure.
Figure 12:
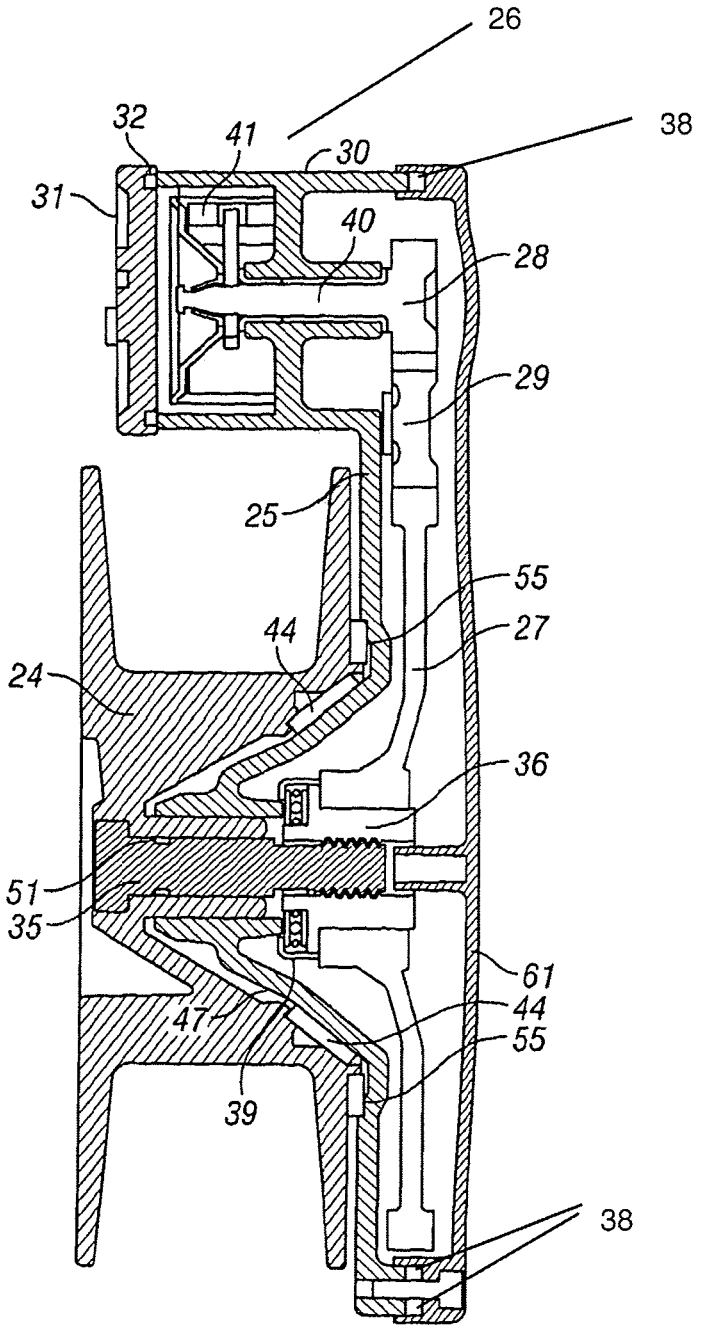
FIG. 12 is a sectional view of the chassis drum and brake arrangement shown in FIG. 2 viewed along line A-A in FIG. 1A.

As shown most clearly with reference to FIGS. 2 and 12, the descent line drum 24 is mounted to a support chassis 25. A brake device 26 is also mounted to the support chassis 25. The brake device 26 is coupled to rotation of the descent line drum 24, by means of a gear arrangement comprising a main gear 27 which rotates with the brake device 26 and is connected to a brake pinion gear 28 by means of an idler gear 29. As the brake device 26 rotates to deploy the descent line 23, the brake pinion gear 28 is activated by the main gear 27 in order to brake the rotation of the descent line drum 24 and slow deployment of the descent line 23.

The speed of rotation of the drum 24 is controlled by the centrifugal servo brake mechanism 26 which is attached the chassis 25 an provided in its own walled housing 30 attached to the chassis and which is closed by an end cap 31. A watertight seal 32 is provided between the end cap 31 and the housing 30. A drum retaining bolt 35 has a hexagonal head that is constrained within a hexagonal recess in the drum such that bolt and drum are constrained to rotate together about the central axis of the drum. Drum retaining bolt 35 has a threaded region that is engaged in a mating threaded region in a specially formed boss 36. Boss 36 is secured to the gear 27 by means of an intervening corrugated tolerance ring 37.

A bearing 39 is provided in order to facilitate rotation of the gear 27 with respect to the chassis 25.

When the drum 24 and bolt 35 rotate in the direction of tightening of the mating screw surfaces between bolt and boss 36, boss 36 will tend to unwind with respect to bolt. Therefore, as drum rotates with respect to the chassis, drive gear 27 will also tend to rotate in the same direction.

Drive gear 27 intermeshes with one or more further gears 29 to drive pinion gear 28 that is constrained to rotate with drive shaft 40 that drives centrifugal brake shoes 41 against cylindrical friction brake lining. As brake shoes 41 rotate, the mass and rotational velocity of each shoe will determine the magnitude of the radial resistance between each brake shoe and cylindrical friction brake lining 43 thereby applying tangential rotational resistance that is translated back through the gear train to drive gear. The resultant rotational drag on drive gear 27 will also apply a rotational drag on boss 36 such that ongoing rotation of drum will tend to tighten bolt into the mating thread in boss 36. Friction material pads 44 are mounted on the drum positioned between opposing conical surfaces of drum 24 and chassis 25. As boss 36 moves along the bolt, the drum 24 is also is also drawn towards the frusto-conical bearing surface 47 of the chassis thereby reducing the rotational speed of drum. As the rotational speed of drum reduces further, the rotational speed of drive gear 27 and ultimately the rotational speed of centrifugal brake shoes reduces thereby also reducing the tendency to tighten the boss 36 onto bolt 35. Eventually, the centrifugal drag from brake shoes will reduce to an extent whereby the thread of the boss 36 tends to unwind with respect to the bolt 35 allowing the drum 24 to move away from the frusto-conical bearing surface 47 of the chassis thereby freeing the drum 24 so that its rotational speed can increase again. In this way, the centrifugal brake 26 acts as a dynamic servo mechanism to regulate the braking force between drum and friction material dependent on the rotational speed of drum thereby also controlling the speed of deployment of the descent line from the drum.

The use of respective conical surfaces on chassis 25 and drum 24 has several important advantages compared with a conventional arrangement using parallel flat interconnecting braking surfaces. The conical form is significantly stronger in compression along its central axis than parallel flat interconnecting surfaces and the braking resistance is also significantly greater for a given axial compression loading. The mating conical surfaces also tend to assist radial location between the drum and the chassis helping to resist contrary radial loading. Since the height rescue apparatus is normally carried attached to a person's harness, it is critically important that the weight and size of the apparatus is as small as possible. In practice, it has been found that the conical bearing arrangement enables the drum to be made from lightweight and low cost plastic materials instead of the heavier and more costly metal alternatives. The amount of material in the chassis can also be minimised. The friction material may be provided in one or more conical or part-conical portions or segments thereof disposed around the periphery of the drum or chassis.

The bolt 35 is provided with an O ring seal 51 sealing on the axial bore of the drum to prevent fluid ingress via the axial bore of the drum.

Between the backplate surface of the drum 24 and the chassis 25 is positioned a compressible/deformable silicon gasket seal 55. This seal prevents fluid passing into the gear train of the device via the gap between the backplate surface of the drum 24 and the chassis 25. It can be beneficial that the gasket seal 55 remains flexible in cold ambient conditions (at least up to −20 Celsius). This is to take up the variation in the separation between the frustoconical bearing surfaces of the drum 24 and the chassis 25 under the braking action as described earlier, even in extreme cold weather conditions.

The device is provided with a back cover 61 mounted to the chassis 25. The back cover 61 and chassis 25 are provided an intermediate seal 38.

The action of providing the seals as described provides a substantially watertight chamber or envelope about the gear train that is robust enough to be maintained even in extreme cold conditions. The flexible resilient silicon gasket seal 55 positioned between the backplate surface of the drum 24 and the chassis 25 is particularly important in this regard.

As shown in FIGS. 1A and 1B, when the rescue descender device 1 is ready for use, it is in the configuration shown. The webbing loop harness connector 16 is connected to the users harness and the upper loop 2 is connected via the safety line 71 (for example a standard self retracting lifeline) to an anchor point. In this way the user is securely anchored to an anchor point via the rescue descender device 1. In this configuration, the release pin 19 cannot be removed from the receiving bores 20 of the load arm mounting component 12. This is because the abutment piece 17 of the pivoting load arm 13 is positioned adjacent the head of the release pin 19 and prevents removal of the release pin 19. In the embodiment shown the torsion spring 18 biases the pivoting load arm 13 to this 'normal' position, although the shape of the pivoting load arm 13 is such that the pivoting moment normally biases the pivoting load arm 13 to this position under gravity in any case. In this configuration the user can move about their business unhindered, but the release pin 19 cannot be removed either intentionally or un-intentionally.

Figure 3A:
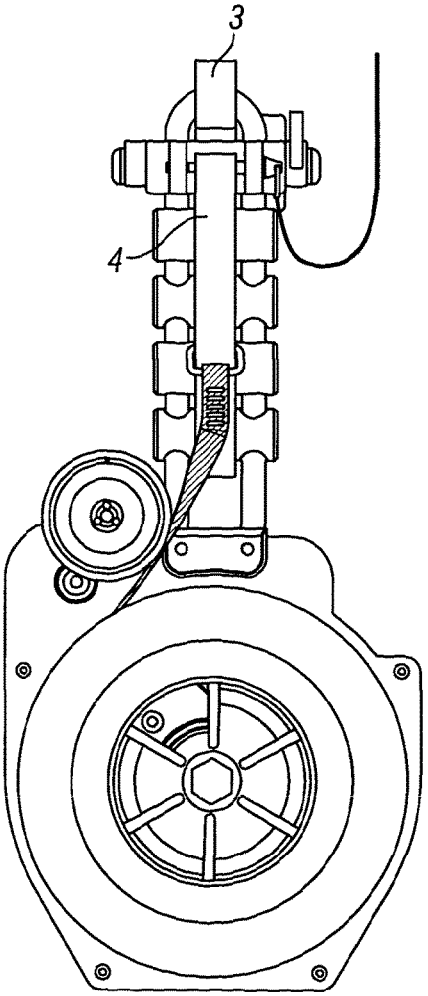
FIGS. 3A and 3 B are face and side views of the rescue descender device 1 of the preceding figures in an alternative configuration.
Figure 3B:
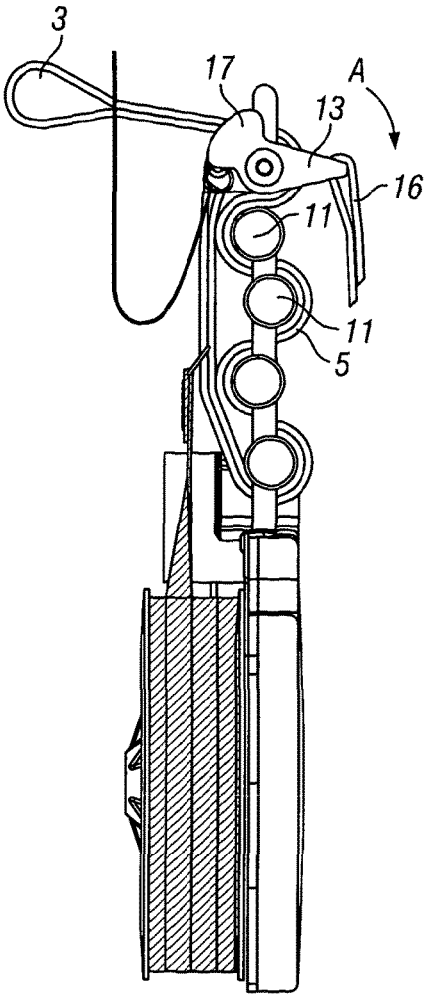
Figure 4A:
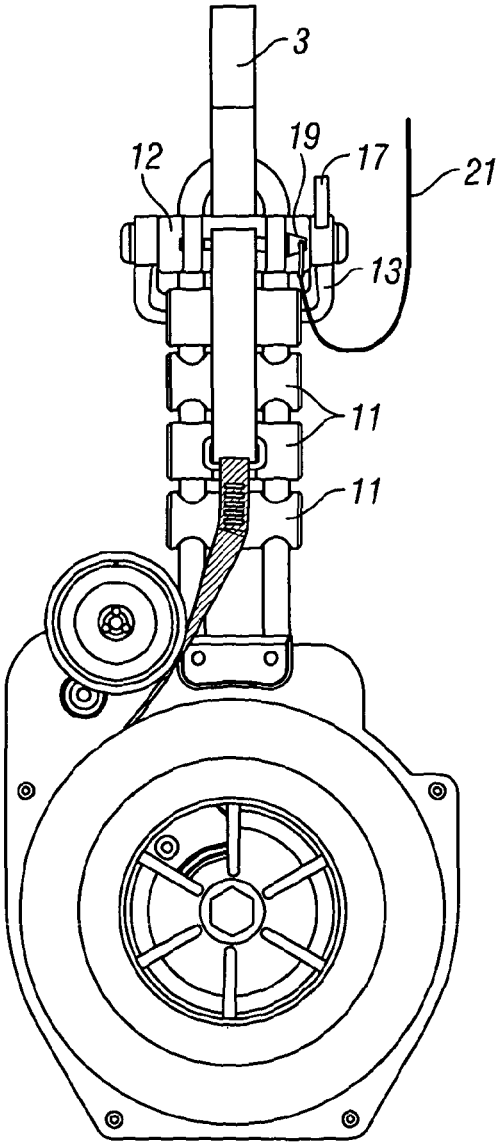
FIGS. 4A and 4 B are face and side views of the rescue descender device 1 of the preceding figures in a further configuration.
Figure 4B:
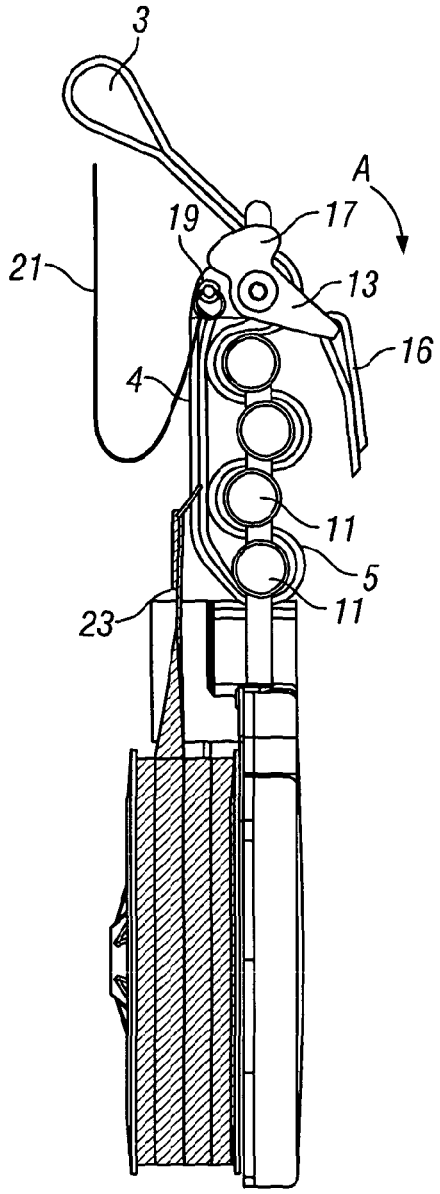

In the event of a fall arrest event, the rescue descender device 1 reconfigures from the position shown in FIGS. 1A and 1B to the position shown in FIGS. 4A and 4B via the intermediate position shown in FIGS. 3A and 3B. As the user becomes suspended from the anchor point via the safety line connected to the upper loop 3 of the first length of the binding webbing 2, the intermediate webbing length 5 pulls up on the series of movable bars 11 causing the movable bars 11 to slide upwardly and pinch the intermediate webbing length 5 securely. This ensures that the intermediate webbing length 5 and the movable bars 11 are held fast. The main upward force acts via the lowermost of the movable bars 11 and the intermediate binding webbing length 5 which is wrapped around the lowermost of the movable bars 11. This configuration is shown in FIGS. 3A and 3B.

Simultaneously, under the weight of the user now suspended from the anchor point, the pivoting load arm 13 pivots downwardly (arrow A). In so doing, the abutment piece 17 of the pivoting load arm 13 pivots out of its blocking position adjacent with the head of release pin 19. Therefore once the fall arrest event occurs and the pivoting load arm 13 is loaded by the user's suspended weight, the abutment piece 17 moves such that the release pin 19 can be pulled out of the receiving bores 20 of the load arm mounting component 12.

In this embodiment the release pin 19 can only be removed from its home position secured in the receiving bores 20 of the load arm mounting component 12 when the pivoting load arm 13 is moved from its normal position. Furthermore the arrangement ensures that the pivoting load arm 13 moves from its home position automatically as a result of a fall arrest event. The pin release tether 21 is connected to the release pin 19 and has an end accessible to be pulled by the user to enable the release pin 19 to be removed when ready.

Figure 6B:
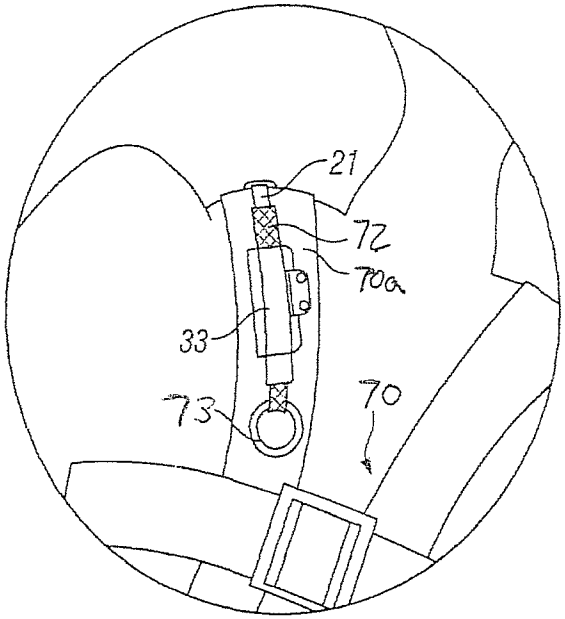
FIGS. 6A to 6D are alternative views showing the descender device of the invention mounted to a harness worn by a user.
Figure 6A:
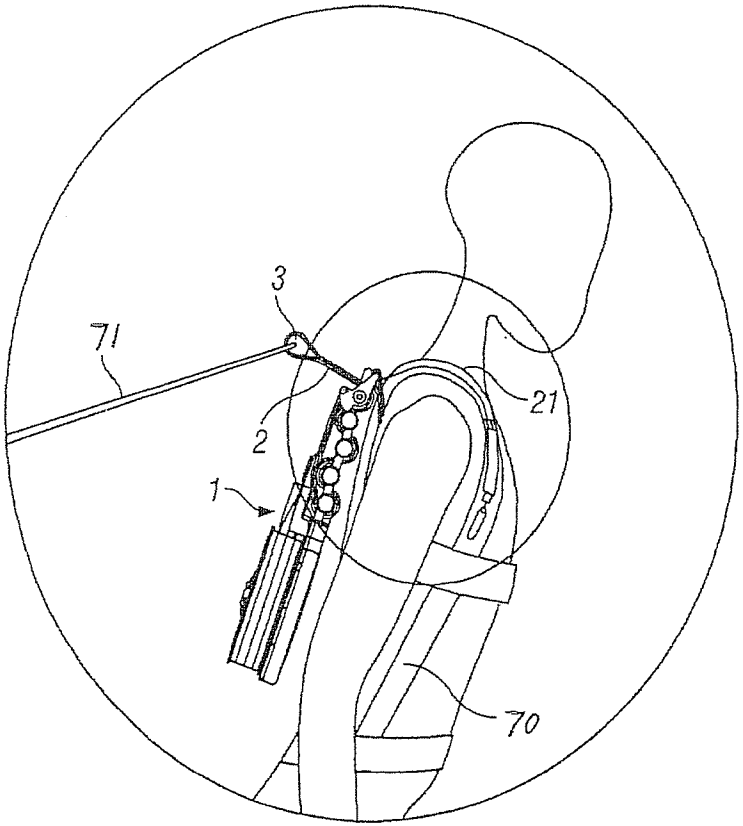
Figure 6C:
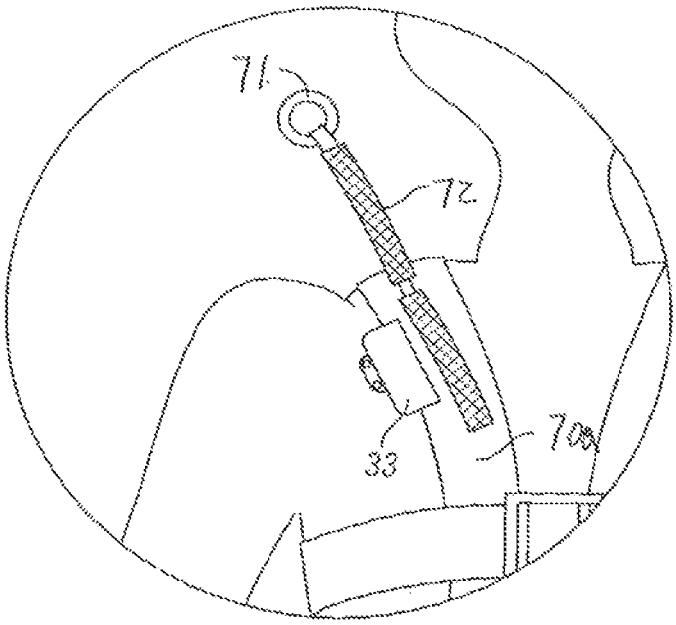

As shown in FIGS. 6A to 6C the release tether 21 can be secured to the harness 70 ready for use. In the embodiment shown the release tether is secured to a shoulder strap 70*a* on the front of the user and a toggle 73 is connected to the tether line 21 to be pulled by the user in order to release the release pin 19. The tether line 21 is provided with a Velcro type band 72 to secure to the shoulder strap 70*a*. An over cover 33 is provided to prevent accidental release.

Figure 5A:
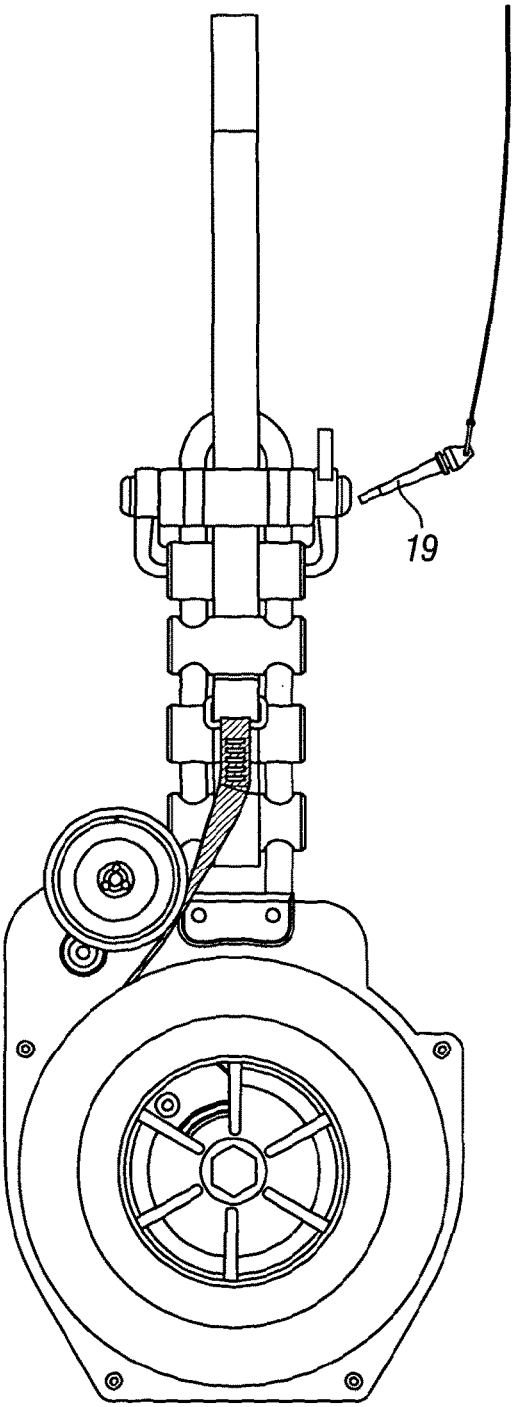
FIGS. 5A and 5B are face and side views of the rescue descender device 1 of the preceding figures in a final configuration.
Figure 5B:
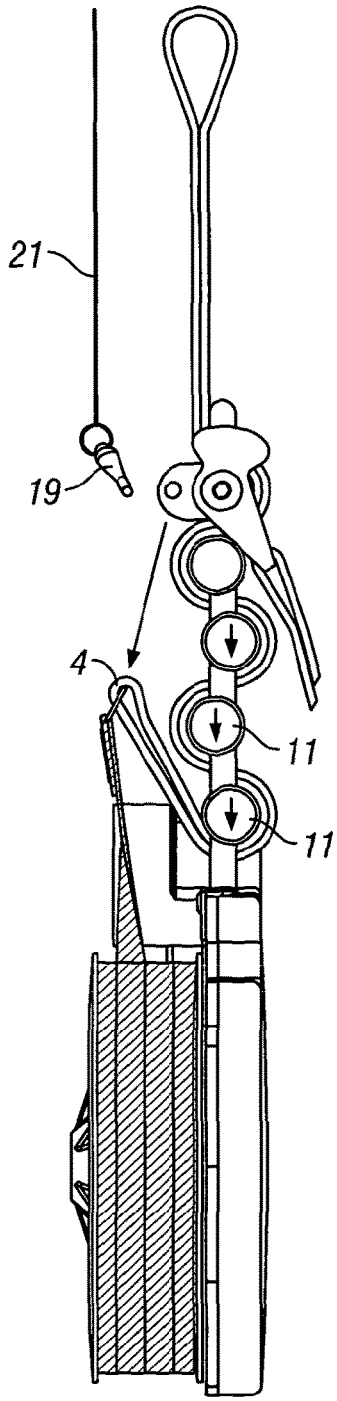
Figure 6D:
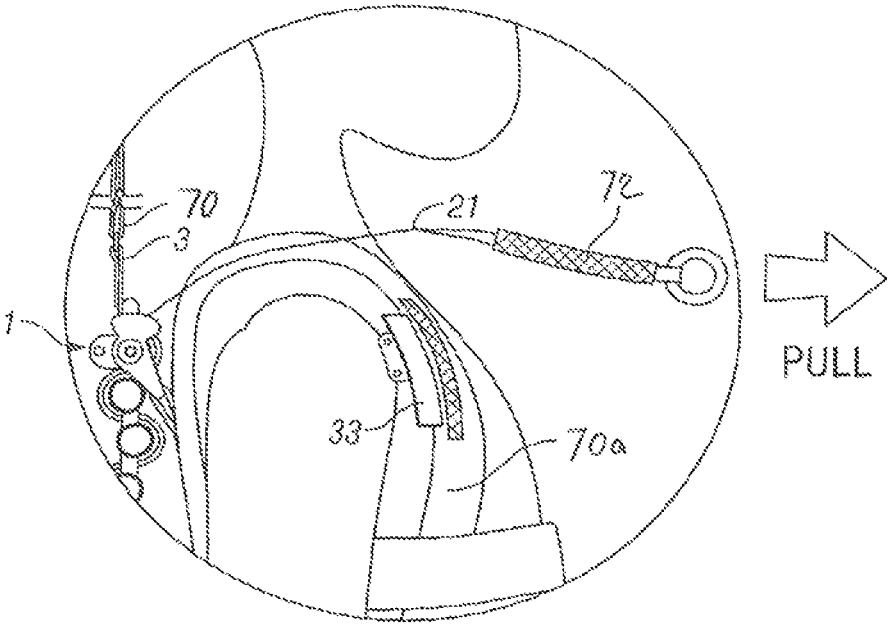
Figure 7:
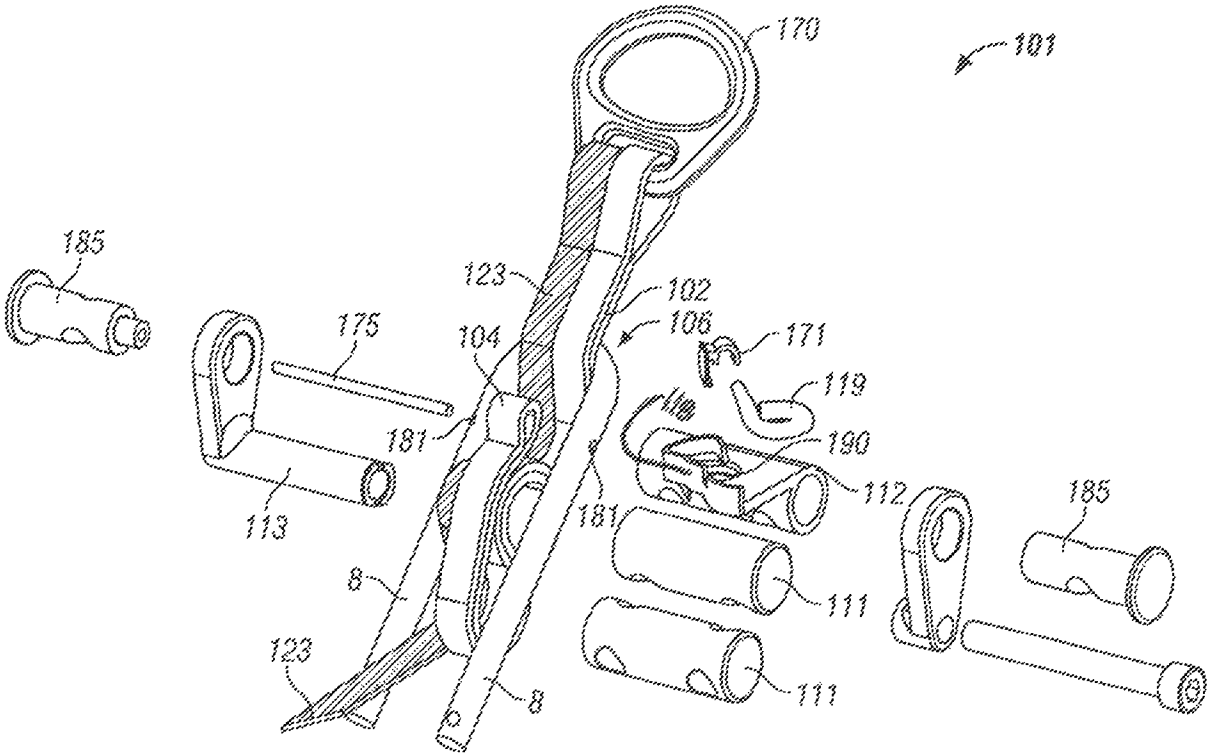
FIG. 7 is a perspective view of the parts making up an alternative embodiment of a descender device according to the invention.
Figure 8B:
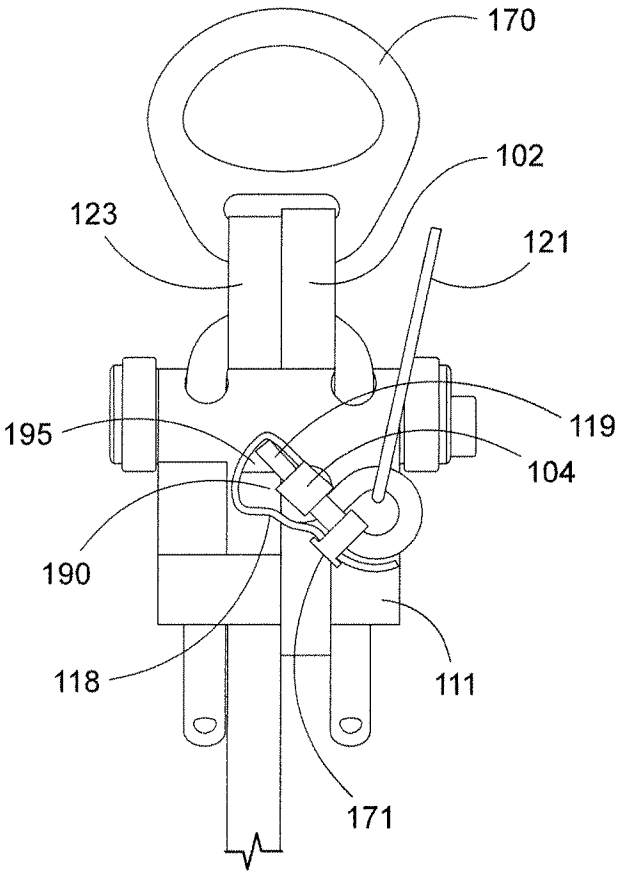
FIGS. 8A and 8B are side and face views of the embodiment of FIG. 7.
Figure 8A:
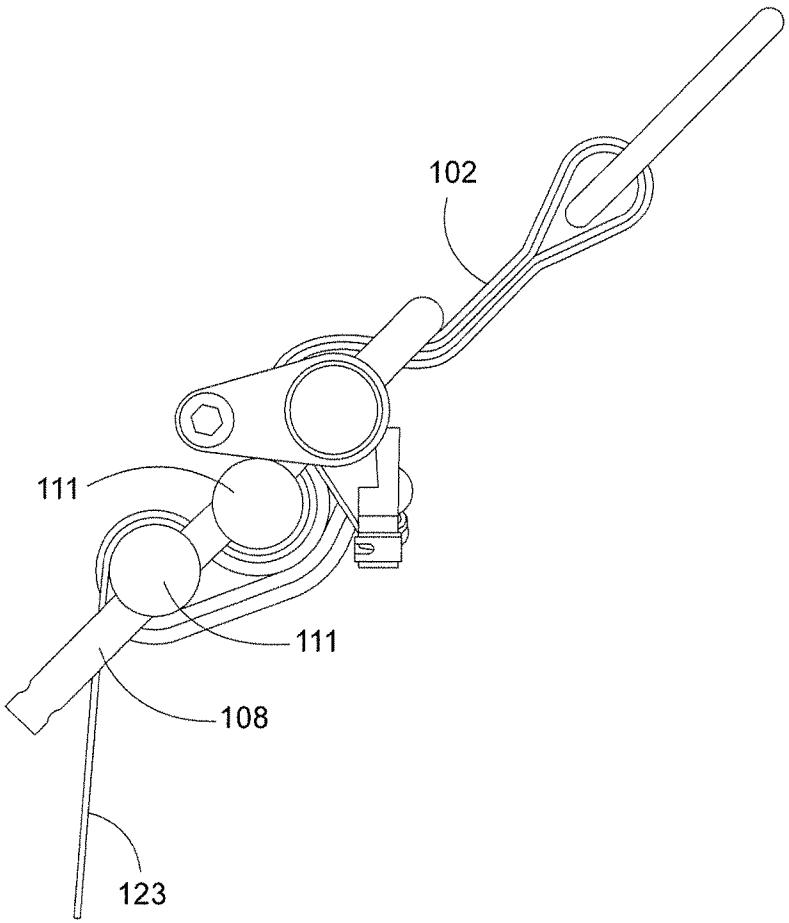
Figure 9:
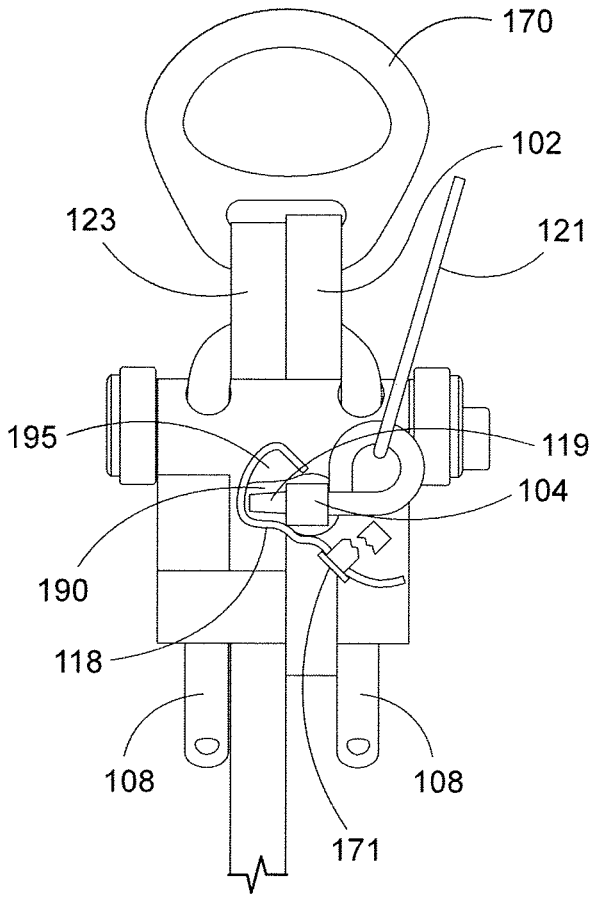
FIG. 9 is a face view of the embodiment of FIG. 7 in an alternative configuration.

Once the user has fallen and his fall has been arrested, he is suspended by the device 1 which is attached to the harness 70 on the back of the user. As shown in FIGS. 6C and 6D, when the user is ready he opens the over cover 33, peels back the band 72 and pulls on the pin release tether 21 to remove the release pin 19 from its home position. The resultant operation is shown in FIGS. 5A and 5B. The release pin 19 releases from the lower loop 4 of the first length of the binding webbing 2. As a result of releasing the lower loop 4 of the first length of webbing, the lower loop 4 can drop down releasing the tension on the intermediate webbing length 5 wound around the lowermost one of the movable pinch bars 11. As a result the series of movable bars 11 can drop downwardly (see the arrows in FIG. 5B) becoming spaced out on the U shaped frame 7. The intermediate webbing length 5 is no longer bound fast by the movable pinch bars 11 and as a result the intermediate webbing length 5 can feed through the pinch bars 11 in an upward direction of the U shaped frame 7.

The closed end of the lower loop 4 catches on the connector clasp 22 and pulls the connector clasp 22 through the movable bars 11 along a serpentine path in an upward direction of the U shaped frame 7. In so doing the descent line 23 is also pulled from the descent line drum 24 along the same path. As a result loop 2 moves away from the U shaped frame 7, and the U shaped frame 7 and the user attached via the webbing loop harness connector 16 descends relative to the upper loop 2. FIGS. 4A and 4B show the connector clasp 22 pulled completely through the U shaped frame 7 and bars 11 together with the upper end of the connector clasp 22. The brake device 26 acts to slow the rate of descent in accordance with a preset desired descent rate.

In this embodiment, the release pin 19 is not a primary load supporting member of the rack restraint device 6. The main vertical load is taken up by the intermediate webbing length 5 folded under the lowermost pinch bar 11. The length 5 is clamped between the pinch bars 11, such that the downward pulling force exerted by the loop 4 on the pin 19 is negligible when compared with the impulse weight or force as a result of the suspended user. Accordingly the force required to remove the pin 19 (when the abutment piece 17 is moved clear of the path of the release pin 19) is sufficiently low to enable the user to remove the pin 19 manually by pulling on the release pin tether 21. The pivoting load arm 13 moves automatically as a result of the load applied by the suspended user to clear the abutment piece 17 from obstructing removal of the release pin 19. The load of the suspended user imparted between the length of webbing 2 (connected to the safety line 71) and the descender device is not transmitted primarily via the release pin 19. The load on the release pin 19 is substantially independent of the load imparted by the suspended user.

The first length of webbing 2 is connected to the descent line 23 by the clasp 22. These can be considered effectively as a single line as they act as such when deployed. The webbing 2 is connected to the safety line 71.

Referring now to FIGS. 7 to 10B, there is shown a further embodiment of a descender device 101, which is similar in general terms to the device 1 of FIGS. 1 to 5. In this embodiment a restraint rack device 106 has a U shaped frame comprising spaced limbs 108 and two pinch bars 111 which are slidably mounted on the limbs 108. The main difference of this embodiment over the first described embodiment is in relation to the connection between the binding webbing 102 and the descent line 123.

In the previously described embodiment the lower loop 4 of the binding webbing 2 was secured to the upper end of the descent line 23 by means of the clasp 22. This requires the clasp 22 to be pulled through the bars 11 when the descent line is being deployed. In practice the clasp can foul or become trapped resulting in non-ideal deployment or even malfunction.

In the embodiment of FIGS. 7 to 10B, the binding webbing 102 and the release line are connected at a D ring 170 which is positioned downstream of the restraint rack device 106 and which therefore does not need to be pulled through the rack during deployment of the release line 123. The upper portion of the release line 123 is threaded serpentine fashion through the pinch bars 111. The binding webbing is likewise threaded serpentine fashion through the pinch bars 111 and the lower loop 104 is secured about a release pin 119 which is secured in a cradle 118 provided on a platform 112 by means of a breakable clip 171. The platform 112 is provided with mounting apertures top enable mounting on the limbs 8 and is secured in position the rack frame device limbs 108 by means of a pin 175 passing through bores 181, and also the mating plugs 185. The swing arm 113 is pivotally mounted on the plugs 185 and provides for securing to the users harness.

Figure 10B:
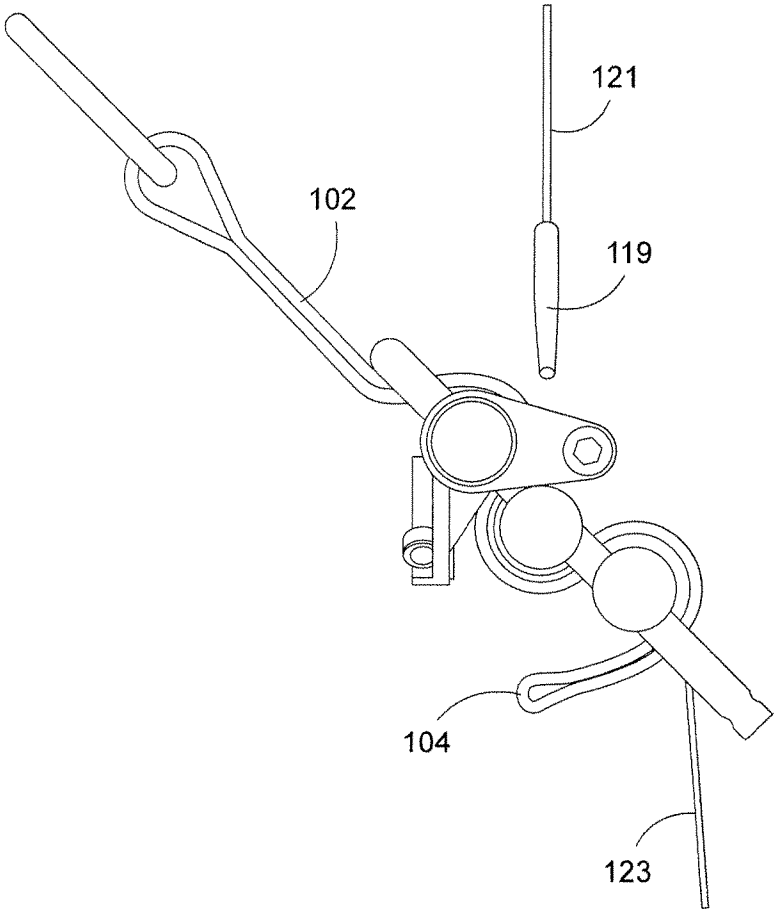
FIGS. 10A and 10B are side and face views of the embodiment of FIG. 7 in an alternative configuration.
Figure 10A:
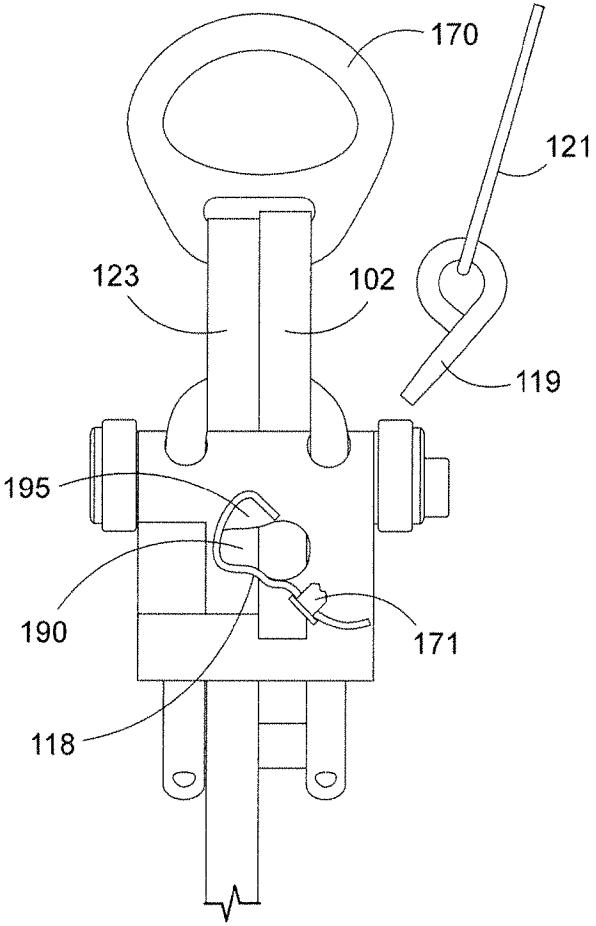
Figure 11C:
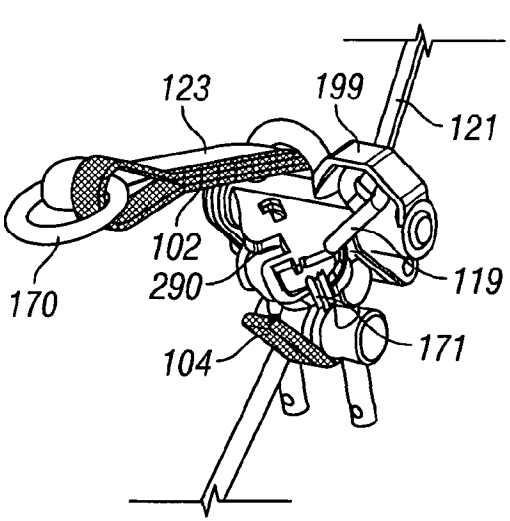
FIGS. 11A to 11C are perspective views of a further embodiment of the invention in various sequential stages of operation.
Figure 11B:
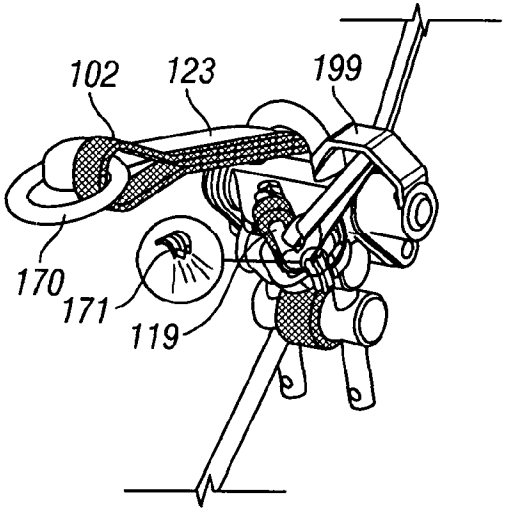

As shown most clearly in FIG. 11*b*, the release pin 119 is secured by the breakable clip 171 in a specific orientation in the cradle 118. When the device is loaded as a result of a fall arrest event, the binding webbing 102 is pulled tight resulting in the pinch bars 111 being pulled upwardly towards the top of the rack device 106. The release line 123 is pinched by the pinch bars preventing the release line 123 from being pulled through the device. In the loaded condition, the loop 104 of the binding webbing 102 is secured over the release pin 119. The webbing 102 extends downwardly from the pin 119 via an opening 190 in the cradle 118. Therefore in the loaded condition, the tension in the webbing 102 tends to securely hold the release pin 119 in the cradle. The end of the pin 119 rests on a ledge 195 adjacent the opening 190. When the user is suspended and wishes to deploy the release line 123, the user tugs sharply on the release pin tether 121. In doing so the release pin ruptures the clip 171 and pivots from the position shown in FIG. 10*b* to the position shown in FIG. 9. In the position shown in FIG. 9 the end of the release pin 119 is no longer supported on the ledge 195 and the downward force acting on the pin by means of the loop 104 causes the loop 104 to be pulled downwardly off the end of pin 119 and through the opening 190. In so doing the binding action exerted by the binding webbing 102 on the pinch bars 111 is released and they are able to move apart on the limbs 108. This enables the binding webbing 102 and the release line 123 to be drawn simultaneously through the pinch bars 111. This situation is shown in FIGS. 10A and 10B.

Figure 11A:
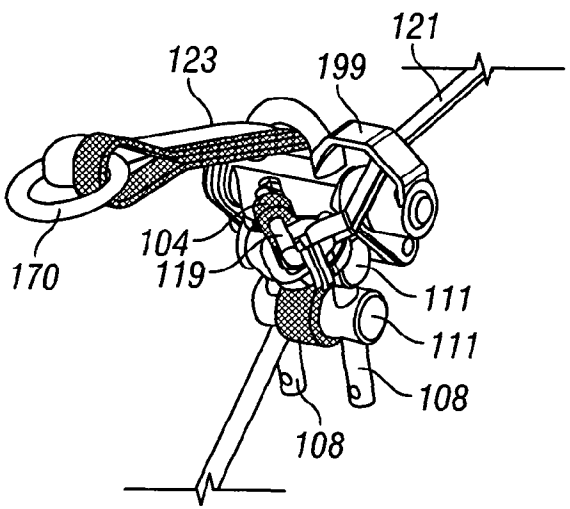

A variation on this theme is shown in the embodiment of FIGS. 11A to 11C, in which like items are referred to with the same reference numbers as the previous embodiment of FIGS. 7 to 10B. In this embodiment the opening 190 is replaced by a slot 290 downwardly through which the end loop 104 of the binding webbing 102 is pulled when the release pin breaks free from the clip 171. A guide frame 199 is provided for the release pin tether 121 in order to ensure that the release pine is pulled from the correct direction to effect release.

The invention claimed is:

1. A descender system for enabling a suspended body to be lowered, the descender system comprising:

a rotatable descent line drum having a backplate surface;

a release element configurable in one of a restraint configuration to inhibit a descent line from being deployed and in a release configuration to permit the descent line to be deployed;

a brake arrangement to apply a braking force to the rotatable descent line drum, the brake arrangement comprising a rotating brake and a gear train connecting the brake to the drum, wherein the gear train is provided in a space sealed by a first seal that is provided between the backplate surface of the drum and a chassis, wherein the first seal comprises a material that is deformable, wherein in at least one configuration the rotatable descent line drum is rotatable relative to the chassis; and a back cover mounted to the chassis, the back cover and the chassis being provided with an intermediate seal.

2. The descender system according to claim 1, wherein: the first seal is comprised of a material that is flexible at temperatures at or below −20 Celsius.

3. The descender system according to claim 2, wherein: the first seal comprises a silicon gasket.

4. The descender system according to claim 1, wherein: the brake is disposed in a walled enclosure having an end cap, wherein a second seal is between the end cap and the wall of the enclosure.

5. The descender system according to claim 1, wherein: the drum is mounted with an axial bolt, the axial bolt having a circumferential seal.

6. The descender system according to claim 1, further comprising:

a clamp arrangement arranged prior to deployment of the descent line, to clamp or pinch at least one of 1) the descent line or 2) a length of release line which is connected to the descent line, or combinations thereof, at one or more points intermediate respective opposed ends of the descent and release lines and spaced from the release element, the clamp arrangement being reconfigurable when the release element is in the release configuration to permit the at least one of the descent and release lines to pass.

7. The descender system according to claim 6, wherein: moving of the release element to the release configuration permits or causes the clamp arrangement to reconfigure from the clamping position, to permit the at least one of the descent and release lines to pass.

8. The descender system according to claim 6, wherein: the clamp arrangement comprises a plurality of bars spaced on a rack, the at least one descent and release lines passing serpentine-wise through the bars in the rack.

9. The descender system according to claim 8, wherein: the spacing of the bars on the rack can reduce to clamp the descent line between the bars or expand to permit the at least one descent and release lines to pass via the bars in the rack.

10. The descender system according to claim 9, wherein: moving of the release element to the release configuration permits or causes the spacing between the bars on the rack to increase from the reduced spacing configuration.

11. The descender system according to claim 6, wherein: the release element is connected to a pull tether that extends in a harness over a shoulder portion of the harness.

12. The descender system according to claim 6, wherein: the release element secures through a loop or ring, which are configured to attach to a flexible lifeline.

13. The descender system according to claim 1, wherein: the release line comprises a binding line, which is secured to the release element in the restraint configuration to inhibit the descent line from being deployed and released from the release element in a release configuration, in order to permit the descent line to be deployed.

14. The descender system according to claim 13, wherein: the binding line and the descent line are configured to both extend through the clamping arrangement before deployment of the release line.

15. The descender system according to claim 14, wherein: the descent line and the binding line are arranged to be drawn through the clamping arrangement in unison when the descent line is deployed.

16. The descender system according to claim 13, wherein: the binding line and the descent line are connected to one another at a position downstream deployment-wise of a clamping arrangement.

17. The descender system according to claim 1, wherein: the release element comprises a pin.

18. The descender system according to claim 1, wherein: the drum is not disposed in the sealed space.

* * * * *